US006129224A

United States Patent [19]

Mingers

[11] Patent Number: 6,129,224

[45] Date of Patent: Oct. 10, 2000

[54] CANTILEVER TYPE SHELF

[75] Inventor: Christain Mingers, Düren, Germany

[73] Assignee: Ohra Regalanlagen GmbH, Kerpen, Germany

[21] Appl. No.: 09/254,989

[22] PCT Filed: Sep. 10, 1997

[86] PCT No.: PCT/EP97/04943

§ 371 Date: May 17, 1999

§ 102(e) Date: May 17, 1999

[87] PCT Pub. No.: WO98/11804

PCT Pub. Date: Mar. 26, 1998

[30] Foreign Application Priority Data

Sep. 17, 1996 [DE] Germany ..... 296 16 189

[51] Int. Cl.[7] ..... A47F 5/00

[52] U.S. Cl. ..... 211/193; 211/190; 211/192

[58] Field of Search ..... 211/193, 189, 211/190, 191, 192, 187; 108/108

[56] References Cited

U.S. PATENT DOCUMENTS

| | | | |
|---|---|---|---|
| 2,790,559 | 4/1957 | Stephenson et al. . | |
| 3,525,442 | 8/1970 | Novales | 211/193 |
| 3,602,374 | 8/1971 | Alabaster | 211/193 |
| 4,023,684 | 5/1977 | Saul | 211/193 |
| 4,065,089 | 12/1977 | Frazier et al. | 211/193 X |
| 4,286,719 | 9/1981 | Hall | 211/193 |
| 5,092,546 | 3/1992 | Wolfbauer | 211/193 X |
| 5,161,701 | 11/1992 | Berny | 211/193 |

*Primary Examiner*—Robert W. Gibson, Jr.
*Attorney, Agent, or Firm*—Friedrich Kueffner

[57] ABSTRACT

A cantilever-bracket shelf unit for elongate products has T-section uprights extending in an upright direction and horizontal spacers connecting the T-section uprights to one another. The T-section uprights have an upright beam and an upright flange connected perpendicularly to the upright beam so as to define the T-section. Cantilever brackets are connected to the T-section uprights and extend perpendicularly to the T-section uprights and the horizontal spacers. The flanges have cutout pairs and each cutout pairs is arranged in a plane parallel to the cantilever brackets. The cutout pairs of each flange are positioned equally spaced in the upright direction. Each cantilever bracket has an end with two hooks each having an insertable region extending through a respective cutout pair to a side of the flange opposite the cantilever bracket. Securing elements for securing the two hooks of the cantilever brackets at the flange are provided, wherein the insertable regions have a receiving opening in which a securing element is horizontally received.

11 Claims, 4 Drawing Sheets

CANTILEVER TYPE SHELF

BACKGROUND OF THE INVENTION

1. Field of the Invention

The invention relates to a cantilever-bracket shelf unit for lengthy products such as boards, pipes, profiled iron sections and the like, which unit includes uprights and horizontal cantilever brackets extending away therefrom, wherein the uprights are constructed as T-section uprights and cut-outs are disposed in the flanges thereof in spaced pairs which are located one above the other at the same spacing. Two hooks are provided as retaining elements at the end of each cantilever bracket for releasably hanging the brackets in the cut-outs.

2. Description of the Related Art

A cantilever-bracket shelf unit of this kind is known from the European patent specification 0 061 514, in which the action of suspending or hanging the cantilever brackets can only ever be effected at a particular angle. Consequently, in order to be able to do this in certain circumstances i.e. in the case of comparatively longer lengths and/or very small clearances of the cantilever-brackets, the brackets located thereabove together with the loads resting thereon firstly have to be removed, thus resulting in an increased workload and loss of time.

DE 35 15 260 A1 depicts a cantilever-bracket shelf unit in which the cantilever-brackets are introducible horizontally and are retainable by means of securing elements. In this construction, the uprights are rectangular tubes which are each traversed by horizontal borings that extend vertically as a series of holes. The cantilever-brackets are formed with two arms from U-shaped edged blanks of sheet metal which are likewise traversed by fixing borings and have an abutment therebelow which, longitudinally of the cantilever-bracket, is spaced from the fixing borings on each side by an amount that corresponds to the spacing between the series of holes and the bearing surface of the uprights. The tolerances to be met by the construction and the arrangement of borings requires a high degree of precision and hence is very labour and cost intensive.

And finally, a cantilever-bracket shelf unit of this kind is known from EP 0 519 316 B1, its design consisting of each hook having a neck that partially increases in thickness in the downward direction and the lower face thereof forming a bearing surface in a part of the lower edge of the cut-out. This form of construction requires an extraordinarily high degree of precision. Thereby, the rising portion of the wedge should have a length in the horizontal direction which corresponds approximately to half the thickness of the flange and be smaller by a tolerance matching of between 0.1 and 0.5 mm than the spacing of the inner face of the hook from the inner surface of the flange, whereby the bearing surface of the neck has to have a horizontal length which corresponds approximately to half the thickness of the flange and finally the height of the hook should be smaller by a tolerance matching of preferably 0.1 to 0.5 mm than the spacing between the lower edges and the upper edges of the cut-outs in the flange.

SUMMARY OF THE INVENTION

Based upon this state of the art, the object of the invention is to substantially improve a cantilever-bracket shelf unit of the type mentioned hereinabove and to equip it with simple means such that, for maximum load bearing capacity, one achieves both trouble-free manufacture and the simplest possible method of assembly and displacement or adjustment of the cantilever-brackets so that they extend uniformly below one another in a plane without any large demands thereby being made on the tolerance limits for the mutually co-operating elements on the uprights and the cantilever-brackets.

In accordance with the invention, this object is achieved, in that the hooks are insertable horizontally with regions thereof through the cut-outs and that an opening is present in the insertable region of each hook, said opening being designed to receive a securing element in a horizontal direction. At the same time, there arises the particular advantage that the securing element conveys the main load or reactive force in the vicinity of a cross-piece of an upright and consequently in the area of greatest rigidity. This results in maximum load bearing capacity.

A manufacturing process that provides accurate fitting and, at the same time, due to the suppression of the need for close tolerances, is economical is considerably facilitated by the construction in accordance with the invention as is also the action of suspending or hanging the cantilever brackets during assembly.

In an advantageous embodiment of the invention, the securing elements for transferring the thrust are securing hooks whose construction is such that they are neither complicated to manufacture nor unergonomic. The use of the securing elements ensures a high degree of stability in the mounted position of the cantilever-brackets on the uprights by means of a surprisingly simple method of mounting with a minimum of working time.

Advantageously, a base plate is attached to the end of each cantilever-bracket, said base plate preferably being of one-piece construction and having a U-shaped cross-section including a cross-piece and longitudinal webs along its sides, the hooks being arranged to project from the one end thereof. Preferably, the base plates are made from blanks of cast steel. They are for example, duplicated parts that are manufacturable in large numbers with consistent dimensions and which are suited above all for production by automatic casting devices at relatively low cost. Alternatively however, they may also be forgings or stamped components.

Furthermore, one advantageous embodiment of the invention consists in that, an opening for receiving an adjusting element is present in the cross-piece of each base plate at the end opposite the hooks. The opening may receive, for example, a standard adjusting screw which can be screwed in and adjusted by a respective adjusting nut on the inner and outer faces of the cross-piece of the base plate. In order to improve the angular adjustment, two adjacently located adjusting elements may also be provided in the lower region of the base plate.

Furthermore, in one advantageous embodiment of the invention, the securing hooks is in the form of a key and comprise a shaft of circular section having a securing lug at one end and a handle element disposed at a right angle at the other end. The openings in the hooks then take the form of a self-locking construction of a keyhole having compatibly shaped passages for the insertion of the securing lugs.

BRIEF DESCRIPTION OF THE DRAWING

Further details, features and advantages of the invention are apparent from the subsequent explanation of the embodiments which are schematically illustrated in the drawings.

DESCRIPTION OF THE PREFERRED EMBODIMENTS

Figure 1:
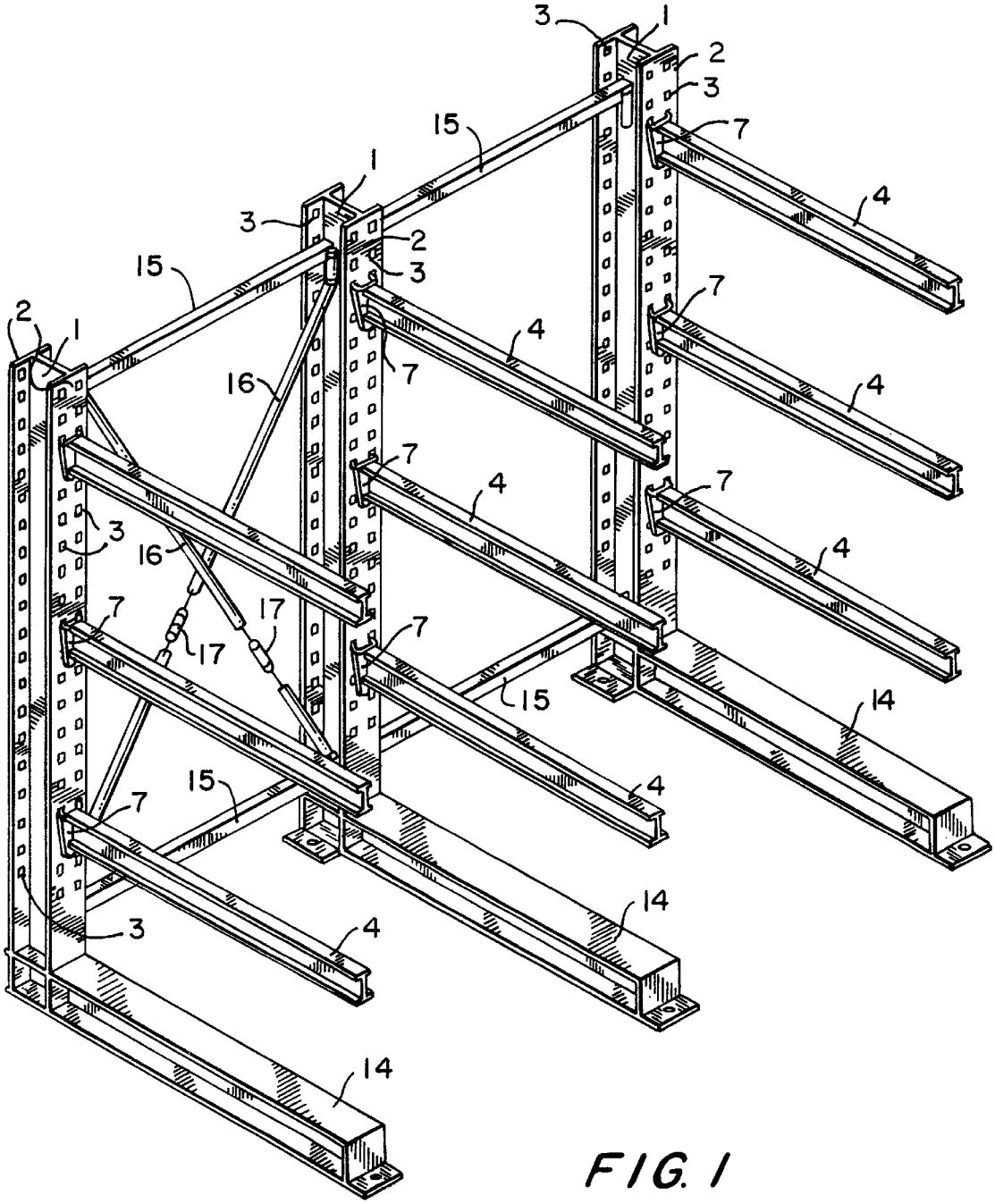
FIG. 1 shows a perspective view of a cantilever-bracket shelf unit.

The cantilever-bracket shelf unit in accordance with the invention which is illustrated in FIG. 1 comprises a plurality of T-section uprights (1), there being at least two uprights per shelf unit. The number of uprights is quite arbitrary. The T-section uprights (1) may be spaced apart with equal or unequal spacing. These T-section uprights (1) are formed as double T-section uprights in the embodiment illustrated. Pairs of cut-outs (3) are arranged in the flanges (2) of the sectional uprights (1). The cut-outs (3) of each pair are located at the same height and the pairs are spaced one above the other in the flanges (2). These pairs of cut-outs (3) may be present in just one flange (2) or in both flanges of a double-T support means (1). Base supports (14) are attached to the lower ends of the uprights (1). Generally known spacers (15) and diagonal tensioning belts (16) with tensioning bolts (17) may be arranged between the uprights (1).

Figure 3:
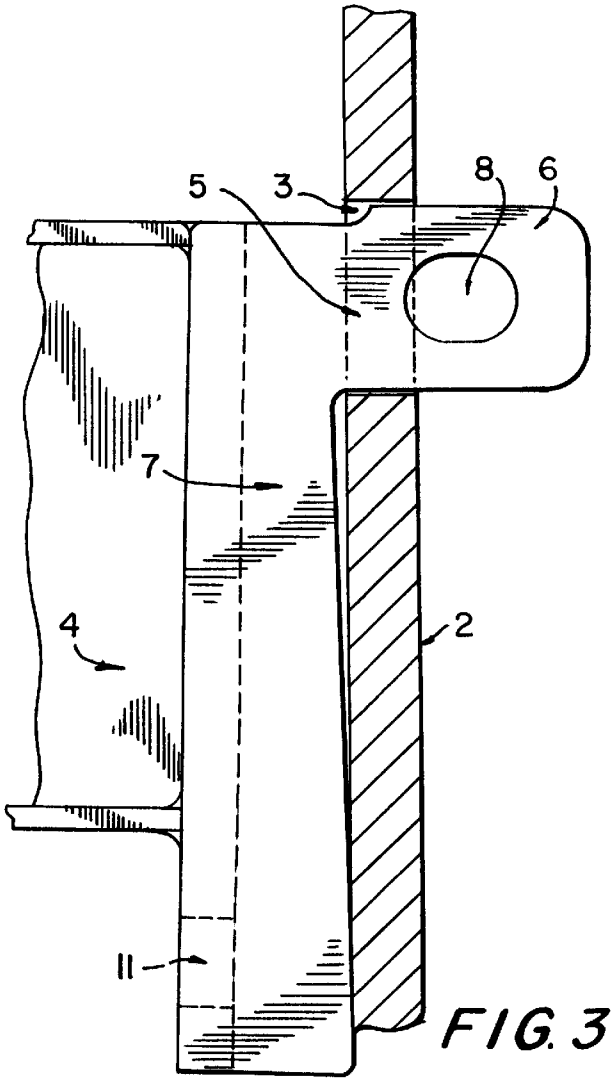
FIG. 3 a cantilever-bracket in accordance with FIG. 2 having a somewhat different construction of the base plate, in the form of a side view, FIGS. 4*a*, 4*b*, 4*c* a base plate in a top-view, side view and bottom view, FIGS. 5*a*, 5*b* a securing element both in side view and in section, FIG. 6 another embodiment of the securing element or securing hook, in the form of a side view.
Figure 2:
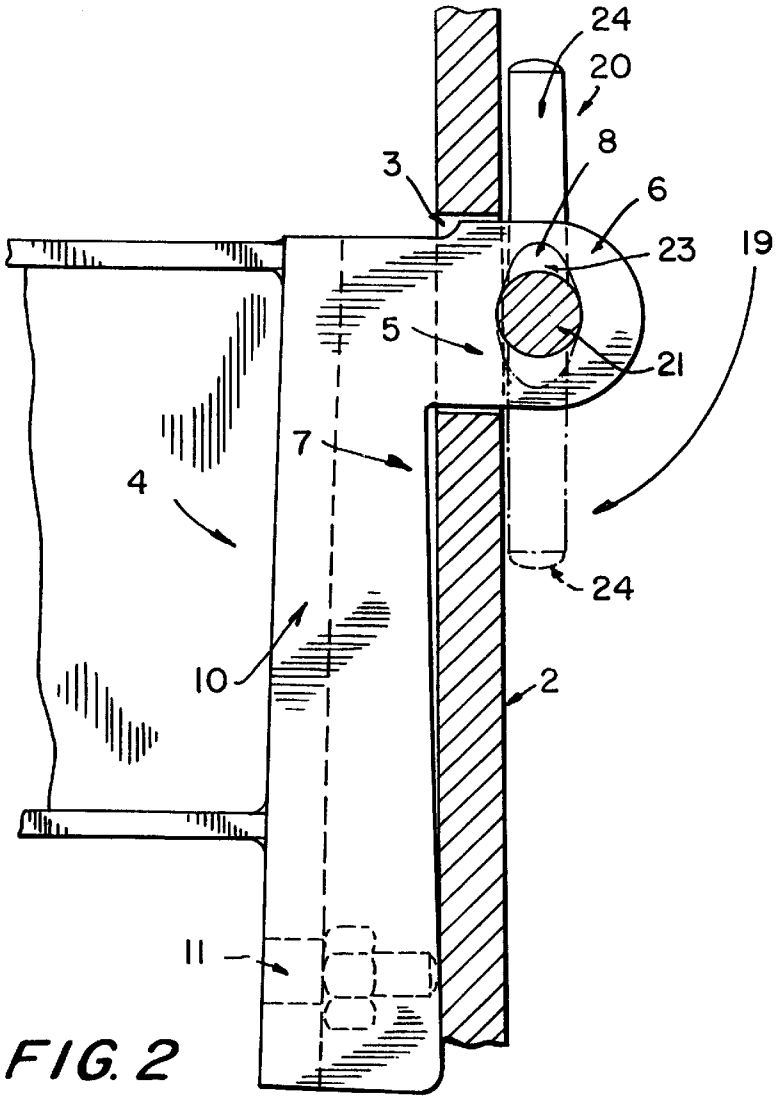
FIG. 2 a side view of an upright with a cantilever-bracket hung thereon.

As shown in FIGS. 2 and 3, the cantilever brackets (4) to be suspended from the cut-outs (3) have at the end to be attached, base plates (7) with hooks (5) which have regions that are insertable in pairs horizontally through a pair of cut-outs (3). An opening (8) is present in the insertable region (6) of each hook (5), said opening (8) being designed to receive a respective securing element (20) in a horizontal direction. As can be taken from FIG. 2, showing the securing element (20) inserted through the opening (8), the securing element is a securing hook (21) that is optimally constructed for conveying the thrust and is of robust and, at the same time, uncomplicated construction. Preferably it is a forging of tempered steel.

Figure 5A:
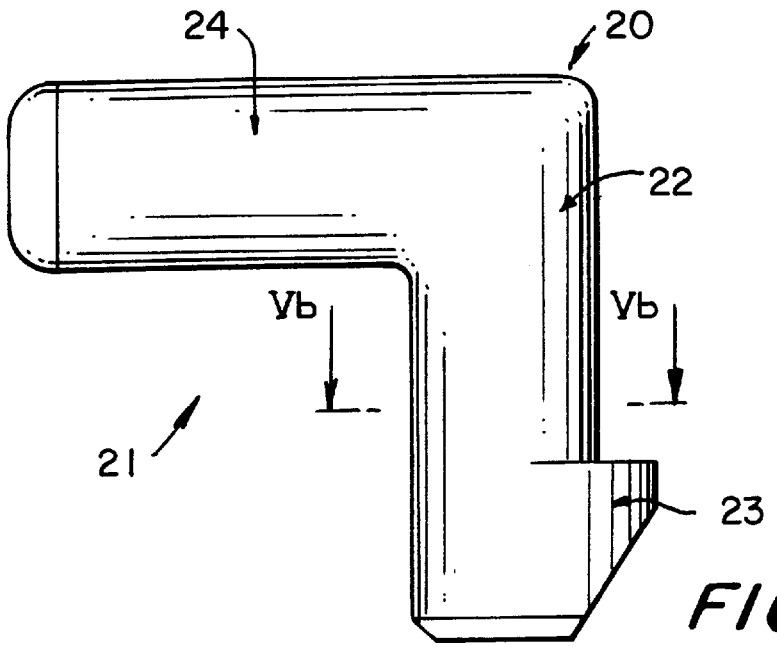
Figure 5B:
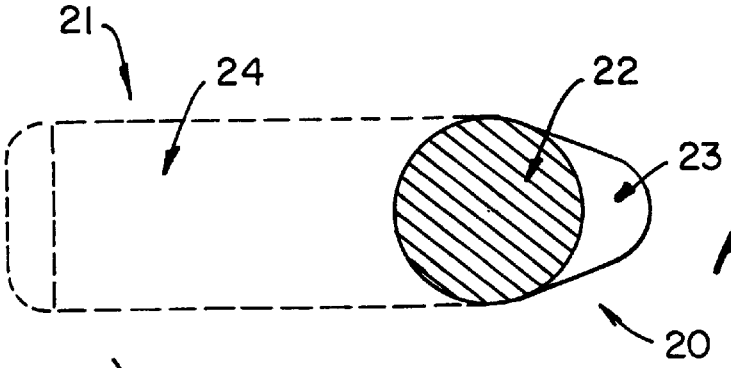

As FIGS. 5*a* and 5*b* show in detail, it has a circular shaft (22) with a securing lug (23) and comprises a handle element (24) for actuating it. The handle element (24) may be arranged to be aligned with the securing lug (23) as is shown in FIG. 2. With its handle element (24) and securing lug (23) directed upwardly, the securing hook (21) is thereby inserted like a key into the e.g. oval shaped opening (8) that is to be self-locking in the upward direction. Thereafter it is rotated downwardly through 180 degrees by the handle (24) in the direction of the arrow (19) whereby the securing lug (23) pivots into the lower position shown in dotted lines and engages behind the opening (8) in such a way that the securing element (20) is arrested laterally in the location shown in dotted lines. This is the only operational step needed to fix a cantilever-bracket (4) comprising the base plate (7) and the hooks (5) to the flange (2) of a T or double-T mounting means.

Figure 4A:
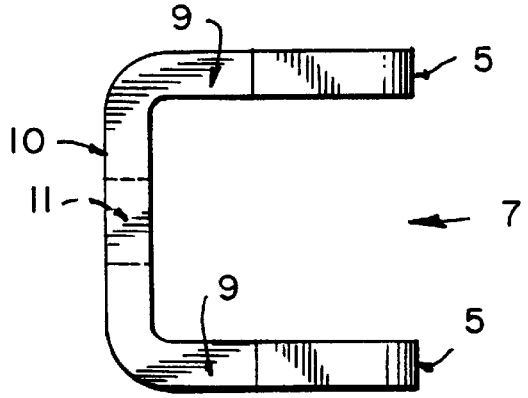
Figure 4B:
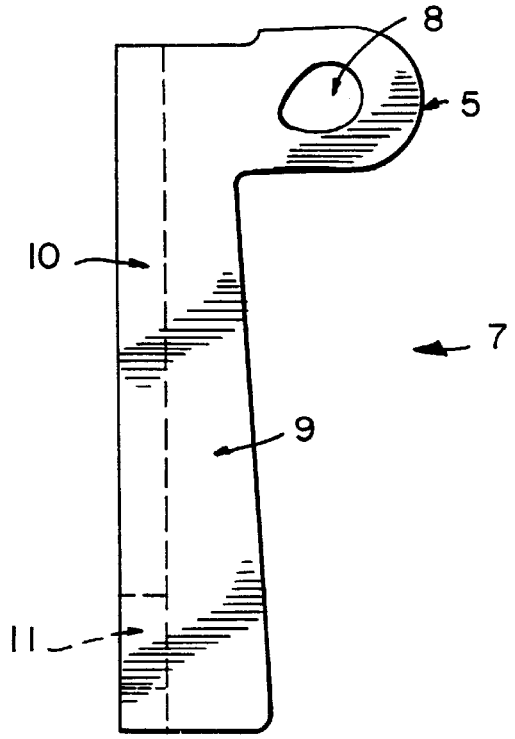
Figure 4C:
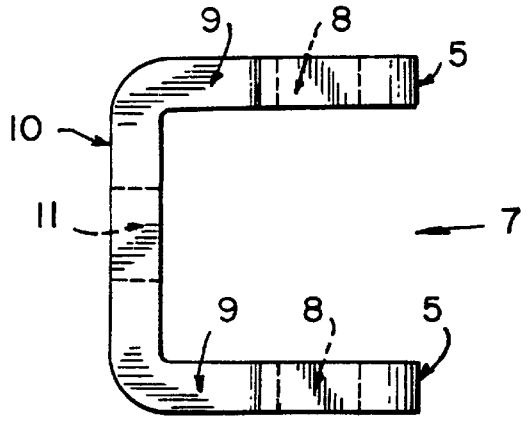

It is apparent from FIGS. 4*a* to 4*c* that the base plate (7) of preferably one-piece construction has a U-shaped cross-section including a cross-piece (10) and longitudinal webs (9) along its sides, the hooks (5) being arranged to project from the one end thereof. Openings (8) are present in the hooks (5) for the insertion of a securing element (20). This opening (8) may preferably be of self-locking construction and have a shape other than circular, i.e. elliptical, ellipsoidal or oval or one that is similar to an elongated slot. Furthermore, an opening (11) for receiving an adjusting element is present in the cross-piece (10) of the base plate (7) at the end opposite the hooks (5). As shown in FIG. 2, the adjusting element may be any sort of screw which is supported against the inner surface of the flange (2) to a greater or lesser extent in dependence on the position of the screw. It can correct the horizontal position of each cantilever-bracket (4) in the simplest and most economical of manners.

The construction of the securing element (20) or of the securing hook (21) in the form of a key in FIGS. 5*a* and 5*b* is purely exemplary, whereby the opening (8) in the base plate (7) co-operating therewith is constructed in the form of a keyhole and has a matching passage for insertion of the securing lug as is shown in FIGS. 2, 3 and 4*b* for example. The actual shape of the securing lug and the matching design of the opening (8) in the hooks (5) of a base plate (7) is left to the discretion of the skilled person. The securing function is, as is indicated in FIG. 5*b*, effected by simply changing the position of the handle element (24) in correspondence with the arrow (19) after inserting the shaft (22) with the securing lug (23) through an opening (8). The quite uncomplicated shaping of the securing element (20) is clearly apparent from FIGS. 5*a* and 5*b*.

Figure 6:
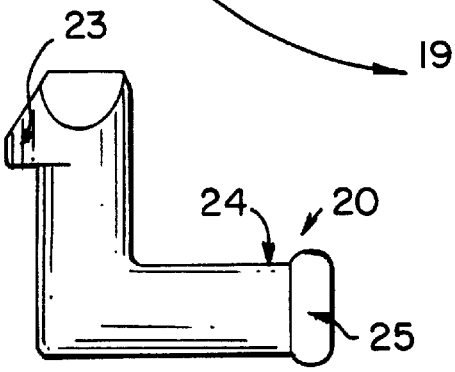

In accordance with FIG. 6, the handle element (24) of the securing element (20) is preferably provided with a bead (25) at its tip for preventing it from being accidentally inserted into the opening (8). This increases the reliability when mounting a cantilever-bracket (4).

Self-evidently, the constructional shapes shown for the co-operating elements, the base plate (7), the hooks (5), the securing element (20) are exemplary and not required. Other designs falling within the skills of the artisan are possible in dependence on the construction of the cantilever-bracket shelf unit insofar as they correspond to the basic concept of the invention and provide a solution to the problem posed hereinabove. For example, the securing element (20) may be formed with a shaft (22) that is lengthened such that it extends through both hooks of a pair of hooks in a base plate (7) when it is inserted. The arrangement might thereby be simplified still further. In addition, a lug or other constructive solution may be found instead of the bead (25). The particular constructional design is left to the devices of the skilled man in conformity with the specific application of the inventive arrangement.

I claim:

1. A cantilever bracket shelf unit for elongate products, the shelf unit comprising:

T-section uprights extending in an upright direction;

horizontal spacers connecting the T-section uprights to one another;

each one of the T-section uprights having an upright beam and an upright flange connected perpendicularly to the upright beam so as to define a T-section;

cantilever brackets connected to the T-section uprights and extending perpendicularly to the T-section uprights and the horizontal spacers;

the flanges having cutouts arranged in cutout pairs, wherein each one of the cutout pairs is arranged in a plane parallel to the cantilever brackets and wherein the cutout pairs of each one of the flanges are positioned equally spaced in the upright direction of each one of the flanges;

each one of the cantilever brackets having an end with two hooks, wherein the two hooks each have an insertable region and wherein the insertable regions are configured to extend through a respective one of the cutout pairs to a side of the flange opposite the cantilever bracket;

securing elements for securing the two hooks of the cantilever brackets at the flange;

the insertable regions each having a receiving opening configured to horizontally receive one of the securing elements.

2. The cantilever bracket shelf unit according to claim 1, wherein the securing elements are thrust-transferring securing hooks.

3. The cantilever bracket shelf unit according to claim 1, wherein the end of each cantilever bracket has a base plate extending substantially parallel to the flange to which the cantilever bracket is connected.

4. The cantilever bracket shelf unit according to claim 3, wherein the base plate is of a one-piece construction and comprises a cross-piece having longitudinal sides and lateral longitudinal webs connected to the longitudinal sides so as to extend perpendicularly to the cross-piece and to define a U-shaped cross-section of the base plate, wherein the two hooks are connected to a distal side of the lateral longitudinal webs facing away from the cross-piece at an end portion of the distal side, the two hooks projecting away from the cross-piece.

5. The cantilever bracket shelf unit according to claim 4, wherein the base plate comprises an adjusting element and wherein the cross-piece has an opening configured to receive the adjusting element, wherein the opening is positioned remote from the two hooks.

6. The cantilever bracket shelf unit according to claim 2, wherein the thrust-transferring securing hooks each have a shaft of a circular section, the shaft having a first end having a securing lug extending at a right angle to the shaft and further having a second end having a handle element extending at a right angle to the shaft.

7. The cantilever bracket shelf unit according to claim 6, wherein the receiving opening defines a keyhole and wherein the shaft, the securing lug, and the handle element define a key, wherein the securing lug is configured to match the keyhole to allow the securing lug to pass through the keyhole.

8. The cantilever bracket shelf unit according to claim 7, wherein the handle element has a bead at an end thereof remote from the shaft for preventing insertion of the handle element into the keyhole.

9. The cantilever bracket shelf unit according to claim 2, wherein the securing element is a forged member made of tempered steel.

10. The cantilever bracket shelf unit according to claim 1, wherein the receiving opening is configured to be self-locking for the securing element by having an elongate shape.

11. The cantilever bracket shelf unit according to claim 10, wherein the receiving opening is elliptical, ellipsoidal, or oval.

* * * * *